US005939658A

United States Patent [19]

Muller

[11] Patent Number: 5,939,658

[45] **Date of Patent: *Aug. 17, 1999**

[54] PORTABLE TACTICAL SHIELD SYSTEM

[76] Inventor: Elizabeth B. Muller, 46A Forbell Dr., Norwalk, Conn. 06850-1421

[ * ] Notice: This patent issued on a continued prosecution application filed under 37 CFR 1.53(d), and is subject to the twenty year patent term provisions of 35 U.S.C. 154(a)(2).

[21] Appl. No.: 09/048,480

[22] Filed: Mar. 26, 1998

Related U.S. Application Data

[63] Continuation-in-part of application No. 08/832,939, Apr. 3, 1997, abandoned.

[51] Int. Cl.[6] ..... F41H 5/24; F41H 5/013

[52] U.S. Cl. ..... 89/36.04; 89/36.02; 109/49.5

[58] Field of Search ..... 89/36.05, 36.02, 89/36.06, 36.11, 36.08, 36.04; 2/2.5; 109/49.5

[56] References Cited

U.S. PATENT DOCUMENTS

| | | | |
|---|---|---|---|
| 3,751,100 | 8/1973 | Keyes | 296/95 C |
| 4,249,589 | 2/1981 | Loeb | 160/354 |
| 4,546,863 | 10/1985 | Kaufman | 89/36.05 |
| 4,774,724 | 10/1988 | Sacks | 2/2.5 |
| 5,170,690 | 12/1992 | Smirlock et al. | 89/36.08 |
| 5,431,318 | 7/1995 | Garcia | 2/2.5 |
| 5,448,938 | 9/1995 | Fernandez et al. | 89/36.02 |
| 5,703,316 | 12/1997 | Madden, Jr. | 89/36.08 |

*Primary Examiner*—Stephen M. Johnson
*Attorney, Agent, or Firm*—St. Onge Steward Johnston & Reens LLC

[57] ABSTRACT

A tactical shield system for shielding a doorway or window. The tactical shield system includes an armored curtain and a hook and loop fastening system. The curtain includes overlaid sheets of suitably lightweight and high strength armored material and a top border sewn to the top periphery of the sheets. The curtain also includes a rigid bar contained in the top border. The hook and loop fastening system includes a hook strip sewn to the rigid top border of the curtain, and a loop strip having a layer of adhesive and a removable wax sheet covering the adhesive prior to use. A method of at least partially shielding a doorway or window includes first removing the wax sheet from the adhesive, and securing the loop strip to a wall above the doorway or window using the adhesive, or directly to a door or window. The hook strip secured to the curtain is then fastened to the loop strip secured to the wall, whereby the armored curtain freely hangs in front of the doorway or window to at least partially shield the doorway or window.

5 Claims, 5 Drawing Sheets

PORTABLE TACTICAL SHIELD SYSTEM

CROSS-REFERENCE TO RELATED APPLICATIONS

The present application is a continuation in part of co-pending application Ser. No. 08/832,939 for a "Ballistic Barricade System," filed Apr. 3, 1997, now abandoned.

FIELD OF THE INVENTION

The invention relates to a bullet and explosion proof protection device and, more particularly, to a portable tactical shield system. Even more particularly, the present invention relates to a tactical shield system having an armored curtain. The present invention also relates to a method of deploying the armored curtain in front of a door.

BACKGROUND OF THE INVENTION

Bullet and explosion proof protection devices are used by law enforcement officers and military personal (both generally referred to as "tactical teams") during or in anticipation of armed confrontations or bomb threats. Many of these protection devices are in the form of armored vests, suits, hand-held shields, or portable barricades made of lightweight, bullet-proof material such as KEVLAR, SPECTRA and GOLD fabrics, for example.

As is known, The United State Department of Justice's National Institute of Justice (NIJ) provides a set of specifications for body armor and ballistic armor protection. These specifications are defined as Levels I, IIA, II, IIIA, IIIl and IV, with Level I providing the least protection and Level IV providing the most protection. Level IIIA, for example, is defined as providing protection against every handgun round, while Level IIIl provides protection against high-powered rifle rounds and Level IV provides protection against armor-piercing rifle rounds. Levels IIIA, III and IV, therefore, are generally considered high levels of protection.

Many tactical situations, such as a hostage stand-off or a drug raid for example, require that tactical teams storm a building containing armed and potentially dangerous persons. In these situations, the teams will normally use a battering ram to break through a door of the building. While the door is being rammed, however, the teams are at their most vulnerable to gunfire from within the building.

Accordingly, there is a particular need for a portable armored curtain for protecting tactical teams during the act of battering down a door to gain access to a building. The armored curtain should provide a high level of protection according to NIJ specifications, yet preferably be lightweight, flexible and easily carried. Preferably, the armored curtain should also be quickly, easily and securely deployable in front of a door. Furthermore, the armored curtain should additionally absorb blows from a battering ram without degradation in its armored protection, such that the armored curtain can be deployed between a door and a battering ram while the door is battered. What is also desired is a method of quickly, easily and securely deploying the armored curtain in front of a door, while at all times providing protection to tactical teams.

U.S. Pat. No. 1,418,995 to Wallace discloses protective light armor. The armor is in the form of loosely hanging and overlapping strips of metal chain, which are designed to "catch" bullets and dissipate the bullets' kinetic energy. Wallace, however, does not disclose a quick and easy method or means of deploying the protective armor in front of a door. In addition, it is likely that the metal protective armor, in order to provide a high level of ballistic protection, would be much too heavy for many tactical situations.

U.S. Pat. No. 4,780,351 to Czempoyesh discloses a protective cover for draping around a danger zone for protection against explosions. The cover includes a plurality of layers of protective fabric bounded together at their edges with a border. The fabric, however, is disclosed as KEVLAR, which is unable to absorb battering without losing its protective qualities. The protective cover, therefore, is unacceptable for covering a door while a battering ram is used on the door. Furthermore, Czempoyosh does not disclose a quick and easy method or means for deploying the cover in front of a door.

U.S. Pat. No. 5,377,577 to Bounkong et al. discloses a ballistic blanket having VELCRO strips positioned all around the periphery of the blanket. The VELCRO strips allow more than one blanket to be secured together to form a larger shield. The blanket, however, is comprised of plies of SPECTRA fiber, which degrades upon absorbing blows from a battering ram. The blanket, therefore, is unacceptable for covering a door while using a battering ram on the door. Furthermore, Bounkong et al. does not disclose a quick and easy method or means for deploying the blanket in front of a door.

U.S. Pat. No. 5,405,673 to Seibert discloses a shooting range backstop including panels of ionometric polymer having VELCRO strips for attaching multiple panels together. Ionomeric polymer, however, degrades upon absorbing blows from a battering ram and is, therefore, unacceptable for covering a door while using a battering ram on the door. Furthermore, Seibert does not disclose a quick and easy method or means for deploying the backstop in front of a door.

There also exists a ballistic blanket having VELCRO straps all around its periphery for attaching the blanket to a rectangular metal frame. This blanket is disclosed in a PRO-TECH Armored Products catalog for law enforcement. The metal frame and the attached blanket apparently can be positioned in front of a door to provide a barricade. The fabric, however, is disclosed as KEVLAR, which is unable to absorb battering without losing its protective qualities. The blanket, therefore, is unacceptable for covering a door while a battering ram is used on the door. In addition, the blanket is bulky and relatively heavy at forty pounds and may not be practical for all tactical situations.

What is still needed, therefore, is portable armored curtain that provides a high level of protection according to NIJ specifications, yet is lightweight, flexible and easily carried. The armored curtain will preferably be quickly, easily and securely deployable in front of a door. Furthermore, the armored curtain will preferably absorb blows from a battering ram without degradation in its armored protection, such that the armored curtain can be deployed between a door and a battering ram while the door is battered. What is also desired is a method of quickly, easily and securely deploying the armored curtain in front of a door, while at all times providing protection for tactical teams.

SUMMARY OF THE INVENTION

Accordingly, a general object of the present invention to provide a new and improved portable armored curtain.

A more specific object of the present invention is to provide a portable armored curtain that provides a high level of protection according to NIJ specifications, yet is lightweight, flexible and easily carried.

Another object of the present invention is to provide a portable armored curtain that is quickly, easily and securely deployable in front of a door.

An additional object of the present invention is to provide a portable armored curtain that can absorb blows from a battering ram without degradation in its armored protection, such that the armored curtain can be deployed between a door and a battering ram while the door is battered.

A further object of the present invention is to provide a method of quickly, easily and securely deploying an armored curtain in front of a door, or opening in a building, while at all times providing protection for tactical teams.

These and other objects of the invention are achieved by a tactical shield system for at least partially shielding a door or an opening in a wall, such as a doorway or window. The system includes an armored curtain and a hook and loop fastener. The hook and loop fastener has a hook strip and a loop strip, with one of the hook strip and the loop strip secured to a top border of the curtain. The other of the hook strip and the loop strip is securable with adhesive to the wall above the opening, or to a door or window mounted within the opening. The armored curtain, therefore, can be fastened with the hook and loop fastener to the wall above the opening, or to a door or window mounted within the opening, to at least partially shield the opening.

The present invention also provides a method of at least partially shielding an opening in a wall. The method includes providing a tactical shield system as described above, securing the other of the hook strip and the loop strip to the wall above the opening or to a door or window mounted within the opening, and fastening the one of the hook strip and the loop strip secured to the curtain to the other of the hook strip and the loop strip secured to the wall above the opening.

The present invention provides another method of at least partially shielding an opening in a wall wherein the other of the hook strip and the loop strip is first fastened to the one of the hook strip and the loop strip secured to the curtain. Thereafter, the other of the hook strip and the loop strip is secured to the wall above the opening or to a door or window mounted within the opening. Whereby, the method provides protection to a user while positioning the armored curtain in front of the opening.

The invention and its particular features and advantages will become more apparent from the following detailed description considered with reference to the accompanying drawings.

BRIEF DESCRIPTION OF THE DRAWINGS

The same reference numerals refer to the same elements throughout the various figures.

DETAILED DESCRIPTION OF THE INVENTION

Figure 1:
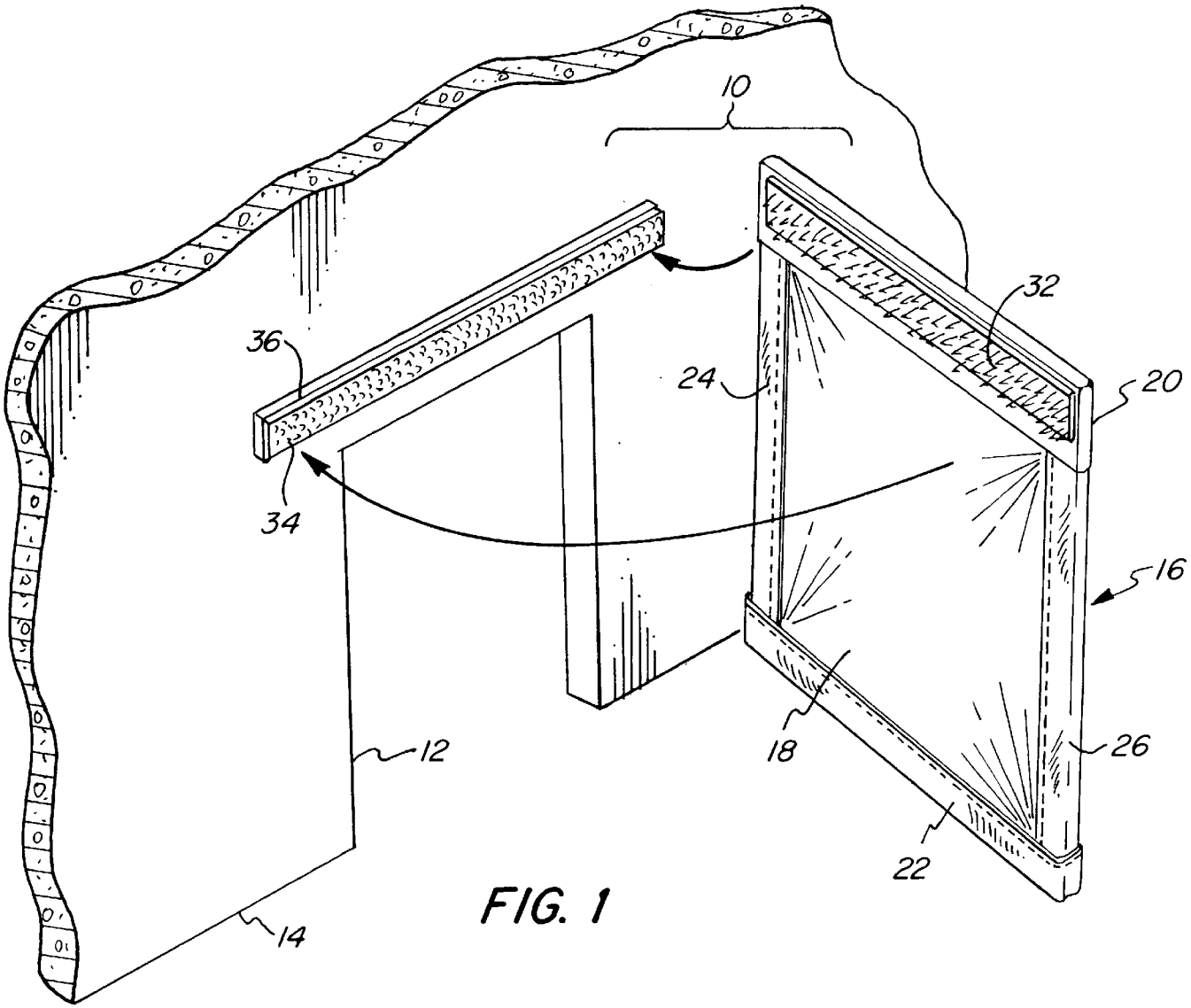
FIG. 1 is a side isometric view of a portable tactical shield system according to the present invention being secured to a wall in front of a door.

Referring first to FIG. 1, the present invention provides a tactical shield system 10 for shielding an opening 12, such as a doorway or window, defined by a wall 14 of a building. Such a system 10 provides protection against gunfire or explosions from within the building for law enforcement officers or military personnel (both hereinafter generally referred to as "tactical teams") trying to enter the building.

Figure 2:
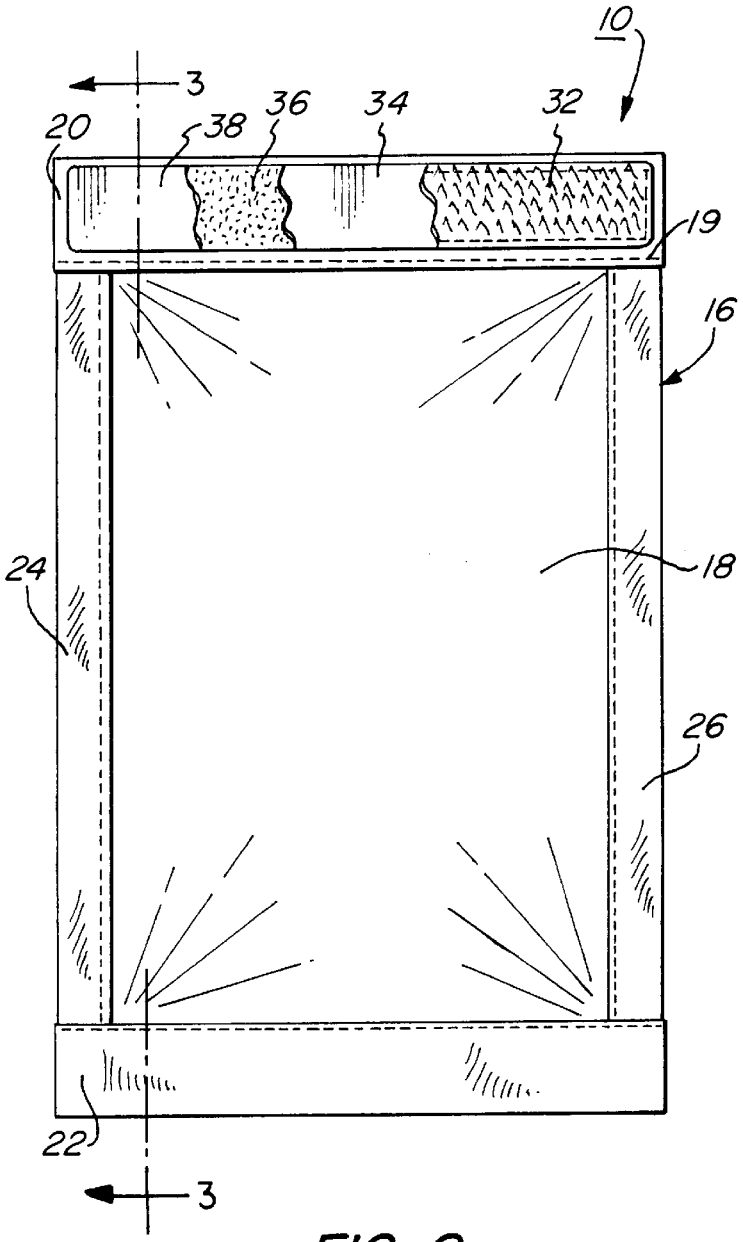
FIG. 2 is a front view, partially cut-away, of the tactical shield system of FIG. 1.
Figure 3:
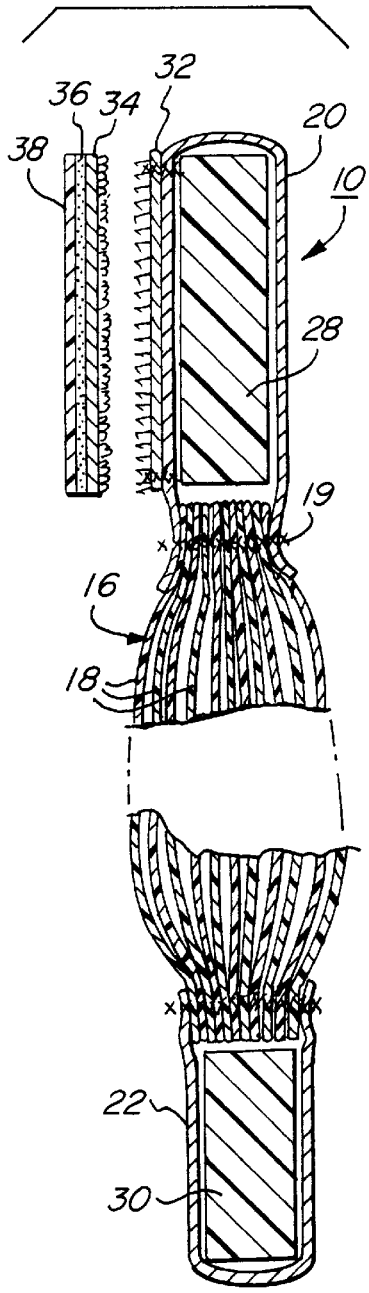
FIG. 3 is an enlarged sectional view of the tactical shield system taken along line 3—3 of FIG. 2.

Referring also to FIGS. 2 and 3, the tactical shield system 10 includes an armored curtain 16 and a VELCRO hook and loop fastener. The curtain 16 includes a shot pack comprised of suitable number of overlaid sheets 18 of lightweight and high strength armored, or bullet-proof, material. The number of sheets 18 of armored material that the curtain 16 includes depends upon the anticipated threat and the type of material used. Resistance to higher caliber weapons or more powerful explosions, for example, may require more sheets 18, and the curtain 16 is accordingly rated. Preferably, the curtain 16 includes at least thirteen sheets 18 of GoldFlex material from Allied Signal Corporation, such that the curtain provides a high level of protection according to NIJ specifications. High level of protection being defined here as between Level IIIA and Level IV protection. Advantageously, the GoldFlex material is also able to absorb ram blows without losing its armored capabilities, as discussed below in more detail.

The curtain 16 also includes a top border 20, a bottom border 22 and side borders 24, 26 made of a suitably strong fabric such as nylon or canvas, for example. The borders 20, 22, 24, 26 are sewn around the periphery of the sheets 18 of armored material to secure the sheets together. The top border 20 is made substantially rigid by containing therein a rigid or semi-rigid bar 28, which extends substantially along the width of the curtain 16 and is made of a suitably lightweight and substantially rigid material such as aluminum, plastic or fiberglass, for example. Stitching 19 between the top border 20 and the sheets 18 acts as a fabric hinge and separates the rigid bar 28 and the sheets 18.

The bottom border 22 is also made substantially rigid by containing therein a rigid or semi-rigid bar 30, which extends substantially along the width of the curtain 16 and is made of a suitably lightweight and substantially rigid material such as aluminum, plastic or fiberglass, for example.

VELCRO, although a trademark of the Velcro Corporation, is used here to generally mean a hook and loop fastener comprising a hook strip 32, having a surface of hooks, that fastens to a corresponding loop strip 34 having a surface of uncut pile. The hook strip 32 is sewn and glued to the top border 20 of the curtain 16. A layer of adhesive 36 is applied to the rear of the loop strip 34, and readily removable protective material, such as wax paper 38, covers the adhesive before use.

It should be noted, that thickness of the hook and the loop strips, the adhesive layer, the removable protective material, and the sheets of armor are shown out of proportion and larger than actually for purposes of illustration.

As an alternatively, the loop strip 34 can be sewn to the curtain 16 and the hook strip 32 could have a layer of adhesive for securing to the wall 14. Regardless, the fastening strength of the system 10 depends upon the number of hooks on the hook strip 32 and the density of the uncut pile on the loop strip 34, and upon the strength of the adhesive 36. Not only is the fastening strength suitable to hold the curtain 16 in position, it is also suitable enough to prevent the curtain 16 from being unattached from the wall 14 upon being struck by a bullet or a bomb blast.

The present invention also provides a method of at least partially shielding the opening 12 in the wall 14. The method includes first removing the protective material 38 from the layer of adhesive 36, and securing the loop strip 34 to the wall 14 above the opening 12 using the adhesive. The curtain 16 is then secured to the wall 14 by pressing the hook strip 32 to the loop strip 34.

The present invention provides another method of at least partially shielding the opening 12 in the wall 14 wherein the loop strip 34 is first fastened to the hook strip 32 secured to the curtain 16. The protective material 38 is then removed from the adhesive 36, and the loop strip 34, with the hook strip 32 and curtain 16 already attached, is secured to the wall 14 with the adhesive. This method is preferred because it provides protection to tactical teams during deployment of the system 10.

The armored curtain 16 is removed from the wall 14 by simply unfastening the hook strip 32 secured to the curtain from the loop strip 34 secured to the wall 14. The tactical shield system 10 can then be provided with a replacement loop strip 34 with adhesive 36 and protective material 38 for reusing at another location. The VELCRO, therefore, allows the system 10 to be reusable. However, it should be understood that the system could simply include an armored curtain having a strip of adhesive.

The curtain 16 can be provided with a height of about 60 inches and a width of about 30 inches, for example, to cover an average doorway. At these dimensions, and considering the high level of protection provided by the system, the total system 10 will surprisingly have a weight of only about 12 pounds. The curtain 16 is also quite flexible and can be folded or rolled-up and conveniently carried in a police car or hand-carried to a building under siege, for example. The rigid bar 30 contained in the bottom border 22 of the curtain 16 helps in rolling the curtain up for compact storage and carrying. In summary, the flexibility, compactness and lightweight of the system 10 make it very practical for use in most, if not all, tactical situations.

Figure 4:
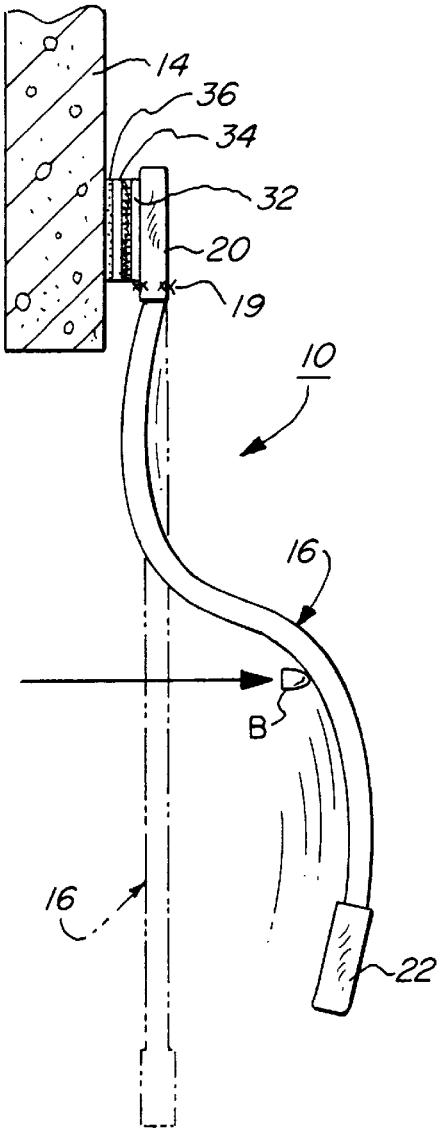
FIG. 4 is a side elevation view of the tactical shield system of FIG. 1 showing an armored curtain of the system "catching" a lethal projectile.

As shown in FIG. 4, the tactical shield system 10 and method of deployment according to the present invention, allow the armored curtain 16 to hang freely in front of a doorway 12 and swing or flutter when struck by a bullet, bomb fragment or other potentially lethal projectile B. The system 10, therefore, works on the principal that the fluttering curtain 16 is able to dissipate at least a portion of the kinetic energy of the bullet B. The curtain 16 can thus be provided with fewer sheets 18 of armor, yet still provide a high level of protection equal to the protection provided by a much thicker and heavier armored barricade rigidly fixed in front of a door.

Figure 5:
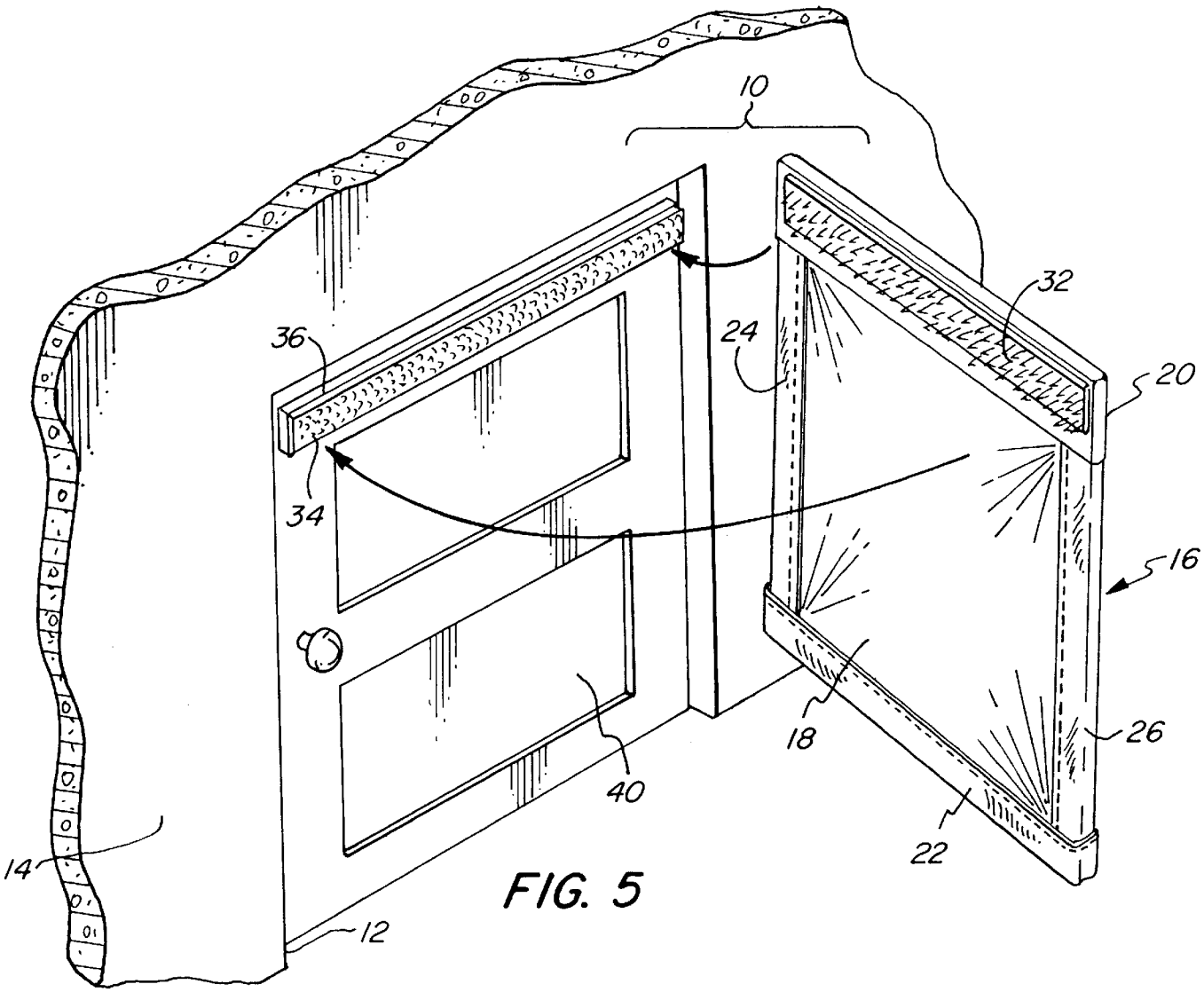
FIG. 5 is a side isometric view of the tactical shield system of FIG. 1 being secured to a door.

Referring to FIG. 5, as an alternative to securing the armored curtain 16 to the wall 14 above the doorway 12, the armored curtain can be secured directly to a door 40 mounted within the doorway. In this way, the armored curtain 16 remains attached to the door 40 as the door is swung open, and allows a tactical team to pass through the doorway 12 unobstructed. Although not shown, the armored curtain can also be secured to a window and, in particular, a frame of a window mounted within an opening of a wall. In addition, the curtain could simply be secured to a wall to protect against gunfire that is able to pass through the wall.

Figure 6:
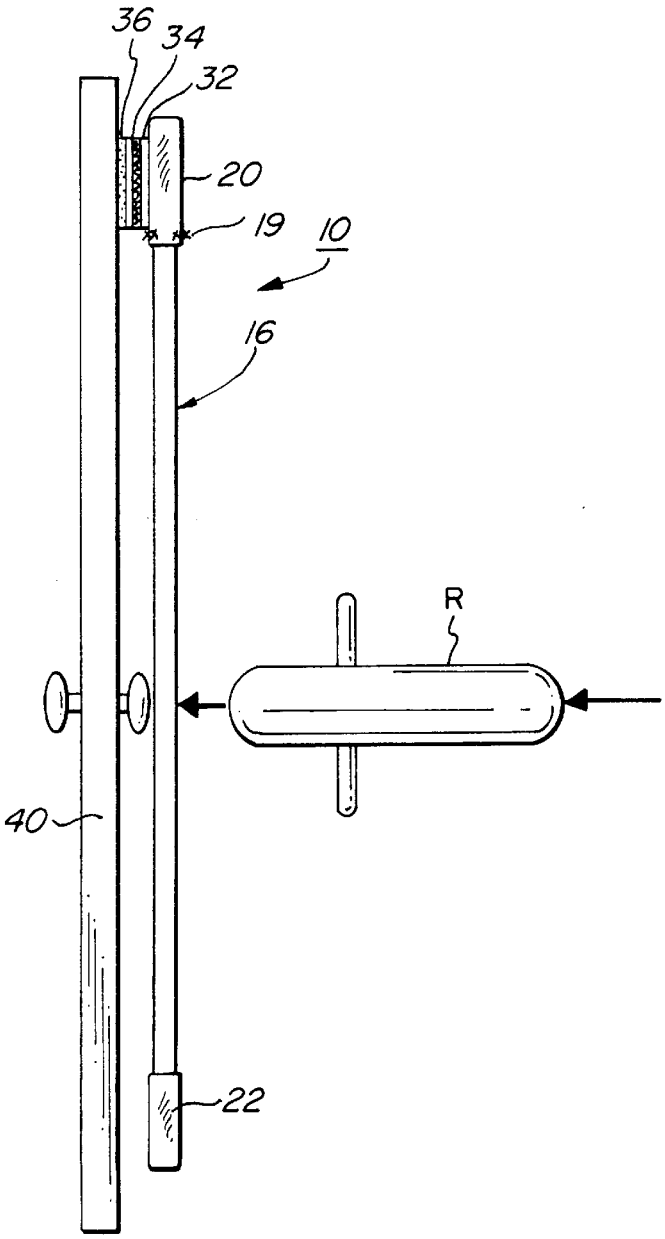
FIG. 6 is a side elevation view of the tactical shield system of FIG. 1 deployed between a door and a battering ram.

A particularly important use for the armored curtain 16 and tactical shield system 10 of the present invention is to protect tactical teams during situations, such as a hostage stand-off or a drug raid for example, wherein the team must storm a building containing armed and potentially dangerous persons. A tactical team will normally use a battering ram R, as shown in FIG. 6, to break through a door 40 of the building. While the door 40 is being rammed, however, the teams are at their most vulnerable to gunfire from within the building.

In such situations, the shield system 10 can be arranged with the loop strip 34 already secured to the hook strip 32 of the armored curtain 16. The protective material 38 is then removed, presenting exposed adhesive 36 for attachment of the curtain 16 to the door 40. The tactical team can approach the door 40 obliquely or directly behind the armored curtain 16, and quickly affix it to the door while being protected by the curtain from gunfire. Once affixed, the curtain 16 will then provide protection to officers while in the process of using the battering ram R to knock down the door 40 and gain entrance.

Most importantly, therefore, the sheets 18 are preferably made of an armored material that not only provides a high level of protection according to NIJ specifications, but is also resistant to blunt impacts or ram blows, such that sheets' armor or bullet-resistant abilities do not degrade upon being struck by the battering ram R. Furthermore, the curtain 16 is thin enough so that it does not significantly hinder the battering ram. In this way, the armored curtain 16 can be hung between the door 40 and the battering ram R while the door is battered down as shown in FIG. 6. Preferably, therefore, the sheets 18 are made of GOLD series fabric, including GOLDSHIELD and GOLDFLEX, which is available from Allied Signal, Inc. of Morristown, N.J.

Figure 7:
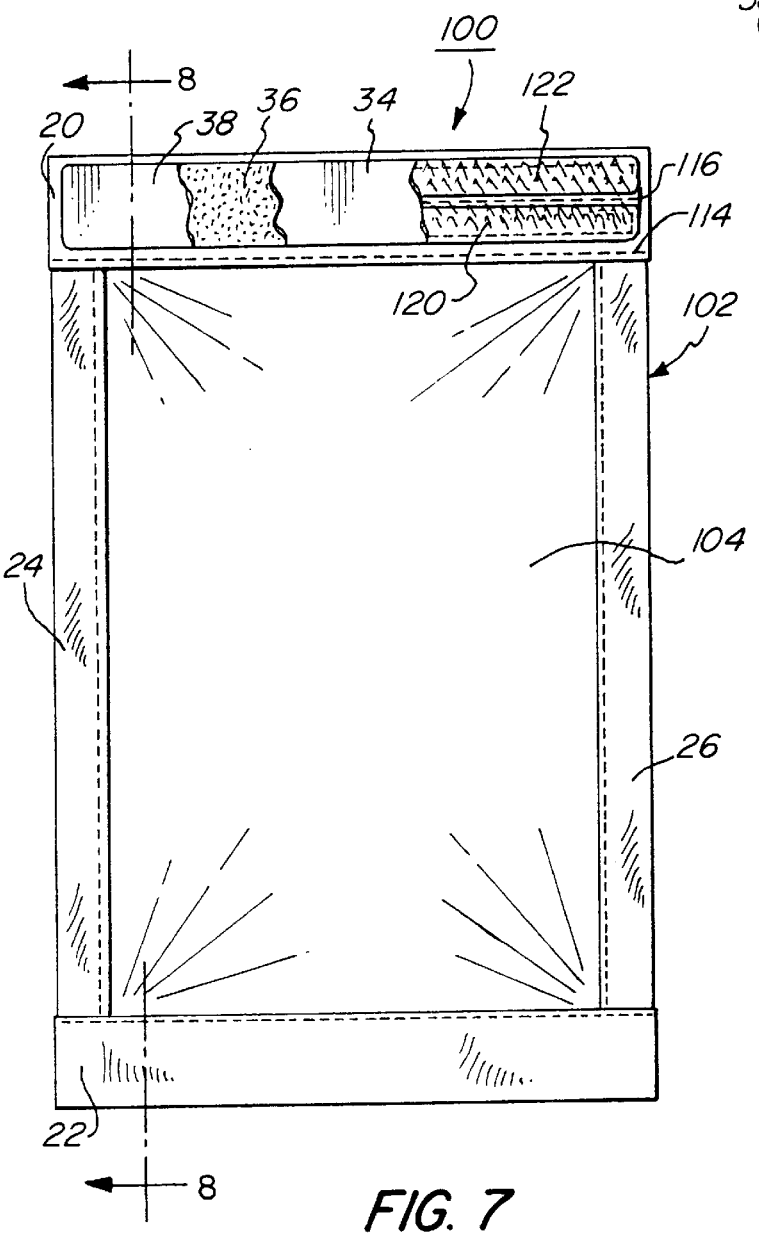
FIG. 7 is a front view, partially cut-away, of another tactical shield system according to the present invention.
Figure 8:
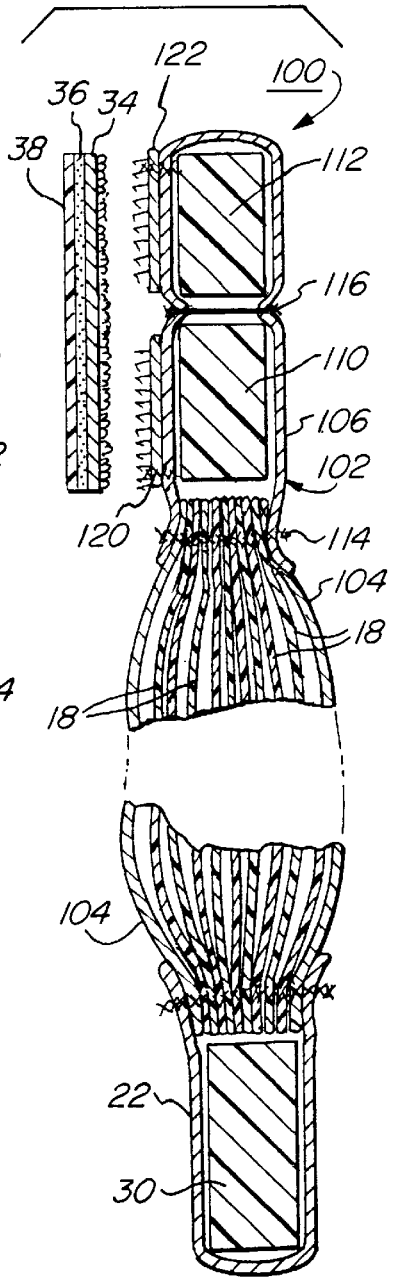
FIG. 8 is a sectional view of the tactical shield system of FIG. 7 taken along line 8—8 of FIG. 7.

Referring to FIGS. 7 and 8, another tactical shield system 100 according to the present invention is shown. The system 100 of FIGS. 7 and 8 is similar to the system 10 of FIGS. 1 through 6, and elements that are the same have the same reference numeral. The tactical shield system 100 includes an armored curtain 102 and a VELCRO hook and loop fastener.

The curtain 102 includes an outer layer 104 of durable and protective fabric, preferable 1500 Denier ballistic nylon, enclosing the overlaid sheets 18 of armor fabric. A top border 106 of the curtain 102 is made substantially rigid by containing therein first and second rigid or semi-rigid bars 110, 112, which each extend substantially along the width of the curtain. The top border 106 is sewn to the top periphery of the sheets 18 and the outer layer 104, such that the stitching 114 acts as a primary fabric hinge between the sheets and the bars 110, 112. The top border 106 is sewn together between the two rigid bars 110, 112, such that the stitching 116 acts as a secondary fabric hinge between the two bars.

A first hook strip 120 is secured to the top border 106 in alignment with the first rigid bar 110, and a second hook strip 122 is secured to the top border in alignment with the second rigid bar 112, such that the hook strips are on opposite sides of the secondary fabric hinge 116 of the top border. Both hook strips 120, 122 fasten to the single loop strip 34 having a layer of adhesive 36 and readily removable protective material 38 covering the adhesive before use.

The primary fabric hinge 114 allows the sheets 18 to swing or flutter while the top border 106 is fixed to a door or wall. In addition, if the swinging or fluttering of the sheets becomes too exaggerated or violent, the secondary fabric hinge 116 provides relief by allowing the first hook strip 120 to become unattached while the second hook strip 122 stays secured to the loop strip 34 to hold the curtain 102 in position.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A tactical shield system for at least partially shielding an opening in a wall, the system comprising:

a generally ballistic-resistant blanket having at least one bullet-proof sheet providing protection against gunfire and explosions, and a top rigid border and a bottom rigid border, the bullet-proof sheet extending between the top and the bottom rigid borders; and a hook and loop fastener having a hook strip and a loop strip, with one of the hook strip and the loop strip secured to the top border of the blanket, and the other of the hook strip and the loop strip securable to the wall above the opening or to a door or window mounted within the opening; and adhesive for securing the other of the hook strip and loop strip to the wall or to said door or window mounted within the opening defined by the wall;

whereby the ballistic-resistant blanket can be fastened to the wall above the opening or to said door or window mounted within the opening with the hook and loop fastener to at least partially barricade the opening.

2. A tactical shield system comprising:

a generally ballistic-resistant blanket having a top border;

two rigid bars contained in the top border, with said top border sewn together between the two rigid bars;

a first hook strip being secured to the top border in alignment with one of the two rigid bars;

a second hook strip being secured to the top border in alignment with the other of the two rigid bars;

bullet-proof sheets of fabric secured to the top border with stitching, with said stitching separating the sheets from the rigid bars; and a loop strip having an adhesive backing.

3. A tactical shield system comprising:

a generally ballistic-resistant blanket having a top border;

two rigid bars contained in the top border, with said top border sewn together between the two rigid bars;

a first loop strip being secured to the top border in alignment with one of the two rigid bars;

a second loop strip being secured to the top border in alignment with the other of the two rigid bars;

bullet-proof sheets of fabric secured to the top border with stitching, with said stitching separating the sheets from the rigid bars; and a hook strip having an adhesive backing.

4. A method of at least partially shielding an opening in a wall against gunfire or explosions, the method comprising:

a. providing a tactical shield system including, a generally ballistic-resistant blanket having at least one bullet-proof sheet providing protection against gunfire and explosions, and a rigid top border and a bottom border, the bullet-proof sheet extending between the top and the bottom borders; and a hook and loop fastener having a hook strip and a loop strip, with one of the hook strip and the loop strip secured to the rigid top border of the blanket;

b. securing the other of the hook strip and the loop strip to the wall above the opening or to a door or window mounted within the opening with adhesive; and c. fastening the one of the hook strip and the loop strip secured to the blanket to the other of the hook strip and the loop strip secured to the wall above the opening or to said door or window mounted within the opening;

d. whereby the ballistic-resistant blanket is fastened to the wall above the opening or to said door or window mounted within the opening with the hook and loop fastener to at least partially barricade the opening.

5. A method of at least partially shielding an opening in a wall against gunfire or explosions, the method comprising:

a. providing a tactical shield system including, a generally ballistic-resistant blanket having at least one bullet-proof sheet providing protection against gunfire and explosions and a rigid top border and a bottom border, the bullet-proof sheet extending between the top and the bottom borders; and a hook and loop fastener having a hook strip and a loop strip, with one of the hook strip and the loop strip secured to the rigid top border of the blanket;

b. fastening the one of the hook strip and the loop strip secured to the blanket to the other of the hook strip and the loop strip; and c. securing the other of the hook strip and the loop strip to the wall above the opening or to a door or window mounted within the opening with adhesive;

d. whereby the ballistic-resistant blanket is fastened to the wall above the opening or to said door or window mounted within the opening with the hook and loop fastener to at least partially barricade the opening.

* * * * *